US007088299B2

(12) United States Patent
Siegler et al.

(10) Patent No.: US 7,088,299 B2
(45) Date of Patent: Aug. 8, 2006

(54) MULTI-BAND ANTENNA STRUCTURE

(75) Inventors: Michael J. Siegler, Inver Grove Heights, MN (US); Robert Sainati, Bloomington, MN (US)

(73) Assignee: DSP Group Inc., Santa Clara, CA (US)

( * ) Notice: Subject to any disclaimer, the term of this patent is extended or adjusted under 35 U.S.C. 154(b) by 0 days.

(21) Appl. No.: 10/976,166

(22) Filed: Oct. 28, 2004

(65) Prior Publication Data

US 2005/0116869 A1 Jun. 2, 2005

Related U.S. Application Data

(60) Provisional application No. 60/515,020, filed on Oct. 28, 2003.

(51) Int. Cl.
*H01Q 9/00* (2006.01)

(52) U.S. Cl. ..... 343/745; 343/702; 343/795

(58) Field of Classification Search ..... 343/702, 343/745, 749, 795, 820, 821, 822
See application file for complete search history.

(56) References Cited

U.S. PATENT DOCUMENTS

| | | | | |
|---|---|---|---|---|
| 4,287,518 | A | 9/1981 | Frosch et al. | |
| 4,495,505 | A | 1/1985 | Shields | |
| 4,825,220 | A * | 4/1989 | Edward et al. | 343/795 |
| 5,495,260 | A | 2/1996 | Couture | |
| 5,532,708 | A | 7/1996 | Krenz et al. | |
| 5,623,271 | A | 4/1997 | Ponnapalli | |
| 5,635,942 | A | 6/1997 | Kushihi et al. | |
| 5,767,812 | A * | 6/1998 | Basciano et al. | 343/722 |
| 5,835,855 | A | 11/1998 | Burns | |
| 5,905,467 | A | 5/1999 | Narayanaswamy et al. | |
| 5,914,695 | A | 6/1999 | Liu et al. | |
| 5,926,139 | A | 7/1999 | Korisch | |
| 5,952,970 | A | 9/1999 | Kawahata | |
| 5,990,838 | A * | 11/1999 | Burns et al. | 343/702 |
| 5,995,048 | A | 11/1999 | Smithgall et al. | |
| 5,999,140 | A * | 12/1999 | Johnson | 343/795 |
| 6,008,773 | A | 12/1999 | Matsuoka et al. | |

(Continued)

FOREIGN PATENT DOCUMENTS

EP 1 182 731 A2 2/2002

OTHER PUBLICATIONS

International Search Report and Written Opinion from corresponding PCT Application Serial No. PCT/US2004/035711, mailed May 10, 2005 (11 pages).

(Continued)

*Primary Examiner*—Tan Ho
(74) *Attorney, Agent, or Firm*—Shumaker & Sieffert, P.A.

(57) ABSTRACT

The invention provides a multi-band antenna structure for use in a wireless communication system. The antenna structure includes integrated inductive elements and capacitive elements that function as a tuned circuit to allow the antenna structure to operate in multiple frequency ranges. In particular, the capacitive elements electromagnetically couple to the inductive elements. The capacitive elements provide the inductive elements with parallel capacitance at a given set of frequencies, thereby providing the antenna structure with frequency selectivity. At a particular frequency range, the inductive elements act as short circuits, thereby lengthening the radiating elements, which radiate energy at the particular frequency. At another frequency range, the inductive components act as open circuits, virtually shortening the radiating elements in order to radiate the higher frequencies. In this manner, the multi-band antenna structure operates within multiple frequency ranges.

27 Claims, 6 Drawing Sheets

U.S. PATENT DOCUMENTS

| | | | |
|---|---|---|---|
| 6,008,774 | A | 12/1999 | Wu |
| 6,072,434 | A | 6/2000 | Papatheodorou |
| 6,081,242 | A | 6/2000 | Wingo |
| 6,115,762 | A | 9/2000 | Bell et al. |
| 6,130,648 | A | 10/2000 | Rulf et al. |
| 6,140,967 | A | 10/2000 | Kolsrud |
| 6,147,572 | A | 11/2000 | Kaminski et al. |
| 6,163,306 | A | 12/2000 | Nakamura et al. |
| 6,177,908 | B1 | 1/2001 | Kawahata et al. |
| 6,181,280 | B1 | 1/2001 | Kadambi et al. |
| 6,208,311 | B1 | 3/2001 | Reece et al. |
| 6,218,989 | B1 | 4/2001 | Schneider et al. |
| 6,232,923 | B1 | 5/2001 | Guinn et al. |
| 6,249,260 | B1 | 6/2001 | Holloway |
| 6,259,933 | B1 | 7/2001 | Bambridge et al. |
| 6,281,843 | B1 | 8/2001 | Evtioushkine et al. |
| 6,281,849 | B1 | 8/2001 | Brachat |
| 6,285,324 | B1 | 9/2001 | Korisch et al. |
| 6,288,679 | B1 | 9/2001 | Fischer et al. |
| 6,295,030 | B1 | 9/2001 | Kozakai et al. |
| 6,300,909 | B1 | 10/2001 | Tsubaki et al. |
| 6,304,158 | B1 | 10/2001 | Nishijima et al. |
| 6,313,797 | B1 | 11/2001 | Kurita et al. |
| 6,313,801 | B1 | 11/2001 | Sanford et al. |
| 6,320,544 | B1 | 11/2001 | Korisch et al. |
| 6,335,703 | B1 | 1/2002 | Chang et al. |
| 6,337,667 | B1 | 1/2002 | Ayala et al. |
| 6,346,913 | B1 | 2/2002 | Chang et al. |
| 6,349,038 | B1 | 2/2002 | Hailey |
| 6,362,792 | B1 | 3/2002 | Sawamura et al. |
| 6,362,793 | B1 | 3/2002 | Sawamura et al. |
| 6,369,771 | B1 | 4/2002 | Chiang et al. |
| 6,377,225 | B1 | 4/2002 | Silverstein |
| 6,396,458 | B1 | 5/2002 | Cockson et al. |
| 6,400,332 | B1 | 6/2002 | Tsai et al. |
| 6,400,336 | B1 | 6/2002 | Gleener |
| 6,407,704 | B1 | 6/2002 | Franey et al. |
| 6,407,717 | B1 | 6/2002 | Killen et al. |
| 6,417,806 | B1 | 7/2002 | Gothard et al. |
| 6,417,809 | B1 | 7/2002 | Kadambi et al. |
| 6,421,011 | B1 | 7/2002 | Van Egmond et al. |
| 6,426,725 | B1 | 7/2002 | Hiroshima et al. |
| 6,429,820 | B1 | 8/2002 | Thursby et al. |
| 6,429,821 | B1 * | 8/2002 | Lewis, Jr. ..... 343/749 |
| 6,539,207 | B1 | 3/2003 | del Castillo et al. |
| 6,542,050 | B1 | 4/2003 | Arai et al. |
| 6,552,689 | B1 * | 4/2003 | Shinichi ..... 343/702 |
| 6,734,828 | B1 * | 5/2004 | Shor ..... 343/795 |
| 2002/0057227 | A1 | 5/2002 | Fang |
| 2002/0123312 | A1 | 9/2002 | Hayes et al. |
| 2003/0020656 | A1 | 1/2003 | Shor |
| 2003/0146876 | A1 | 8/2003 | Greer et al. |

OTHER PUBLICATIONS

Notification of Transmittal of the International Preliminary Report on Patentability from corresponding PCT Application Serial No. PCT/US2004/035711, mailed Dec. 8, 2005 (5 pages).

Greer, Kerry, "New Design Techniques Allow Engineers to Stretch the Limit of Embedded Antenna Design," SkyCross, Inc., www.wirelessdesignmag.com, 5 pages (last printed Mar. 2, 2006).

* cited by examiner

MULTI-BAND ANTENNA STRUCTURE

This application claims the benefit of U.S. provisional application No. 60/515,020, filed Oct. 28, 2003, the entire content of which is incorporated herein by reference.

TECHNICAL FIELD

The invention relates to antenna structures for use in a wireless communication system and, more particularly, to multi-band antenna structures.

BACKGROUND

With the advent of mobile computers, there has been an increased demand to link such devices in a wireless local area network (WLAN). A general problem in the design of mobile computers and other types of small, portable, wireless data communication products is the radiating structure required for the unit. An external dipole or monopole antenna structure can be readily broken in normal use. Also, the cost of the external antenna and its associated conductors can add to the cost of the final product.

In an effort to avoid use of an external antenna, manufacturers have begun to produce devices with embedded antennas. An embedded antenna is typically an antenna that is enclosed within a housing or case associated with the wireless card. For example, a wireless network card may include an antenna embedded within a printed circuit board of the wireless card. In this manner, the antenna forms an integral part of the product.

SUMMARY

In general, the invention is directed to a multi-band antenna structure for use in a wireless communication system. The antenna structure radiates and tunes energy at more than one frequency, thus making the antenna structure a multi-band antenna structure. The multi-band antenna structure may, for example, be integrated within a multi-layer circuit structure such as a multi-layer printed circuit board.

In accordance with the invention, the multi-band antenna structure includes integrated, distributed inductive and capacitive elements that function as a tuned circuit to resonate and tune energy at more than one frequency. The inductive elements may be integrated within radiating components of the antenna structure. For example, a portion of the radiating components may be fabricated using meander line techniques to realize integrated, distributed inductive elements. In addition, the antenna structure may include capacitive elements that reside on a different layer than the inductive elements, and that electromagnetically couple to the inductive elements.

The integrated, distributed inductive elements allow the antenna structure to radiate and tune energy at lower frequencies than the geometries of the antenna structure itself would generally allow. The capacitive elements of the antenna structure support frequency selectivity. In other words, the capacitive elements provide the inductive elements with parallel capacitance at a given set of frequencies, thereby creating a parallel distributed-element tuned circuit.

The electromagnetic coupling between the inductive elements and the capacitive elements allow the multi-band antenna structure to operate in multiple frequency bands. Although operation of the antenna structure is described in the radio frequency (RF) range for exemplary purposes, the antenna structure design can be utilized in other frequency range applications as well.

The dimensions of the inductive and capacitive elements may be chosen such that at lower radio frequencies, e.g., 2.4 GHz, the inductive components act as short circuits, in turn lengthening the radiating elements of the antenna structure. At higher radio frequencies, e.g., 5.0 GHz, the inductive components act as open circuits, thereby shortening the lengths of the radiating elements and thereby achieving a radiating element at those frequencies.

The shorting of inductive components allows the radiating elements to radiate and tune energy at lower radio frequencies than the geometries of the antenna structure itself would generally allow. In this manner, the multi-band antenna structure acts as a varying length antenna structure, thus allowing the antenna structure to radiate and tune energy at multiple frequencies, and support multi-band radio operation.

The multi-band antenna structure may be formed with certain dimensions in order to be tuned to particular operating frequency ranges to conform to a number of standards such as the IEEE 802.11(a), 802.11(b), 802.11(e) or 802.11 (g) standards. For example, the multi-band antenna structure may be formed with a particular capacitive element length and width, inductive element length and width, inductive element meander width, or inductive element spacing to cause the antenna structure to operate in different frequency bands. In another example, the alignment of the inductive elements and the capacitive elements may cause the antenna structure to resonate and tune different frequency bands.

In some embodiments, a multi-layer circuit structure may incorporate more than one multi-band antenna structure. In this case, the multi-band antenna structures may be spaced to provide the multi-layer circuit structure with receive diversity, transmit diversity, or both. The radiating components of the multi-band antenna structures may be spaced relative to one another such that at least one of the radiating components of the antenna structures will be in a position where the signal has not experienced significant distortion from the multi-path effects, thereby offering spatial diversity. Alternatively, the radiating components may be configured to transmit and receive signals at different polarizations, e.g., left-hand circular and right hand circular polarizations, thereby achieving polarization diversity. Other diversity applications, such as frequency diversity, are also possible.

In one embodiment, the invention is directed to an antenna comprising a radiating component to transmit and receive signals, wherein the radiating component includes at least one integrated inductive element and a capacitive element that electromagnetically couples to the integrated inductive element to form a tuned circuit that allows the antenna to operate in more than one frequency range.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
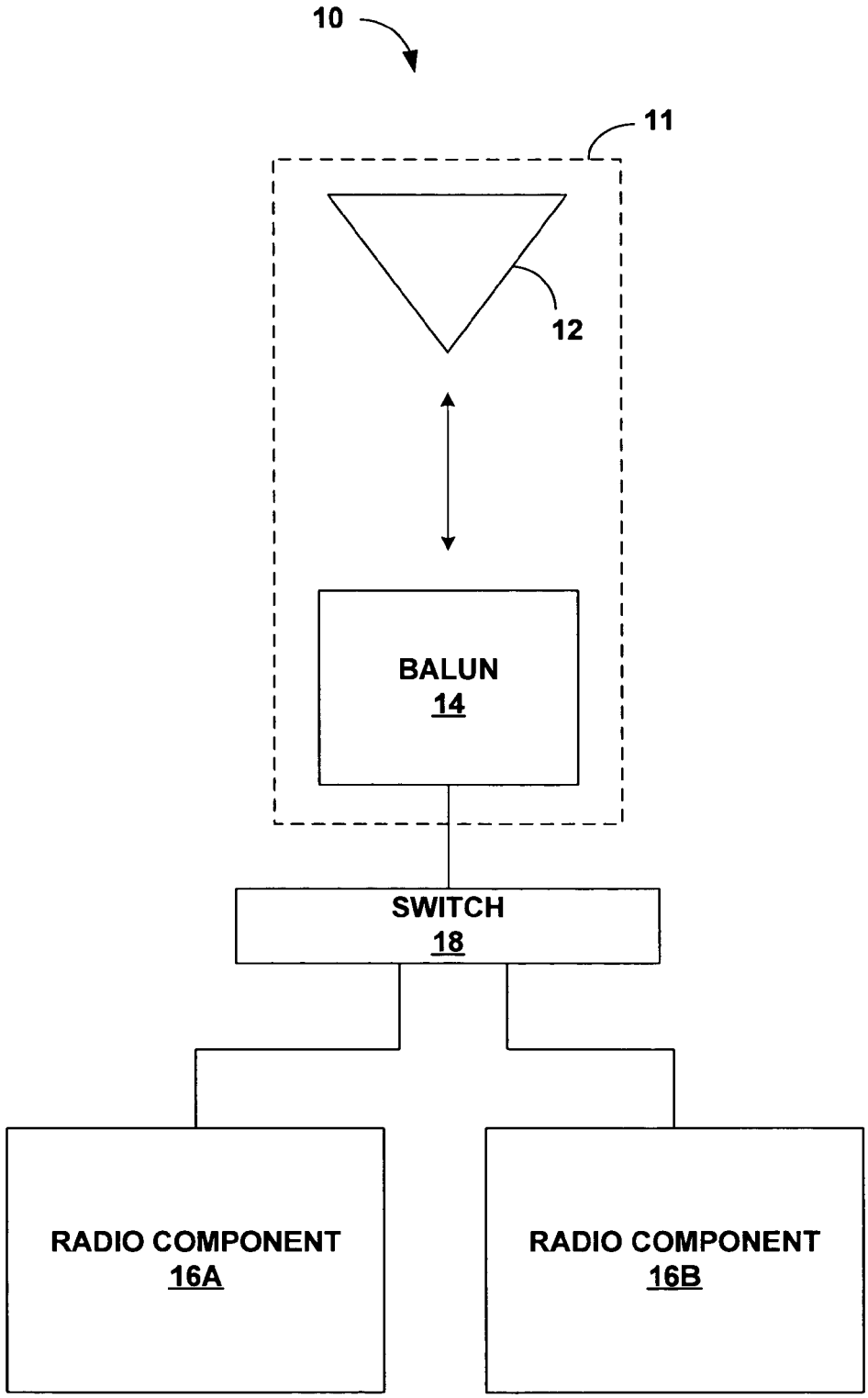
FIG. 1 is a block diagram illustrating a system for wireless communication.

FIG. 1 is a block diagram illustrating a system 10 for wireless communication. System 10 includes a multi-band antenna structure 11 that includes a radiating component 12 and a conductive strip feed-line (not shown) that electromagnetically couples to radiating component 12. As will be described, multi-band antenna structure 11 is created to radiate and tune energy at more than one frequency, thus making antenna structure 11 a multi-band antenna structure. In this manner, a single antenna structure may operate within multiple frequency bands, thus reducing the amount of planar space needed on a circuit structure for multiple antennas. For exemplary purposes, the techniques of the invention will be described with respect to an antenna structure that operates within two frequency bands, i.e., a dual-band antenna structure. However, the techniques may be applied to antenna structures that operate at more than two frequency bands.

In particular, antenna structure 11 includes inductive elements and capacitive elements that function as a tuned circuit to resonate and tune energy at more than one frequency. For example, radiating component 12 may be fabricated to include integrated, inductive distributed elements and capacitive distributed elements. The integrated inductive elements allow antenna structure 11 and, more particularly, radiating component 12 to radiate and tune energy at higher frequencies than the geometries of radiating component 12 allow, thereby creating a series resonant circuit. The capacitive elements of antenna structure 11 perform frequency selectivity. In other words, the capacitive elements provide radiating component 12 with parallel capacitance at a given set of frequencies, thereby creating a parallel distributed-element tuned circuit. As will be described in further detail, the inductive elements and capacitive elements may reside on different layers of a multi-layer circuit structure.

The conductive strip feed-line that couples to radiating component 12 is fabricated to form a balun 14 that directly feeds radiating component 12. The conductive strip feed-line may, for example, electromagnetically couple to radiating component 12 using a quarter-wave open circuit in order to realize balun 14. Balun 14 transforms unbalanced (or single-ended) signals to balanced (or differential) signals and vice versa, i.e., balanced signals to unbalanced signals. For example, balun 14 may transform a balanced signal from a dipole antenna structure to an unbalanced signal for an unbalanced component, such as an unbalanced radio component. Balun 14 may perform impedance transformations in addition to conversions from balanced signals to unbalanced signals. As will be described in detail, radiating component 12 and the conductive strip feed-line forming balun 14 reside on different layers of a multi-layer circuit structure, such as a multi-layer printed circuit board.

As shown in the example illustrated in FIG. 1, multi-band antenna structure 11 couples to radio components 16A and 16B ("16") via a switch 18 or diplexer. Switch 18 or a diplexer directs energy between radio components 16 based on the frequency at which system 10 is operating. For example, radio component 16A may be a 2.4 GHz radio component and radio component 16B may be a 5.0 GHz radio component. In this case, switch 18 or a diplexer may couple antenna structure 11 to radio component 16A when antenna structure 11 is operating in a 2.4 GHz environment, e.g., an 802.11(g) environment, and couple antenna structure 11 to radio component 16B when antenna structure 11 is operating in a 5.0 GHz environment, e.g., an 802.11(a) environment. In other embodiments, antenna structure 11 and radio components 16 may be coupled via a diplexer or other switching mechanism.

The diagram of FIG. 1 should be taken as exemplary of a type of device that may couple to antenna structure 11, however, and not as limiting of the invention as broadly embodied herein. Multi-band antenna structure 11 may couple to various other unbalanced devices. For instance, multi-band antenna structure 11 may couple to other unbalanced components within the same multi-layer circuit structure.

Figure 2:
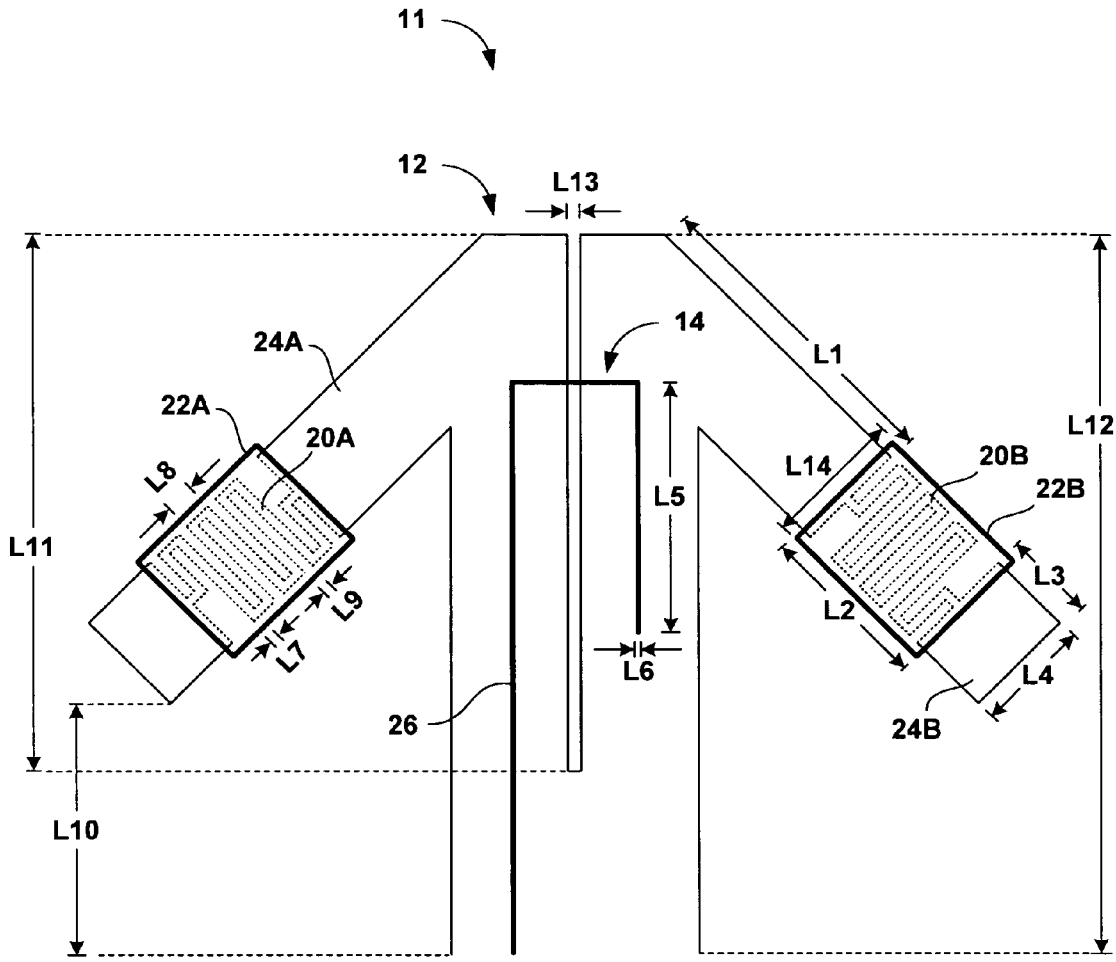
FIG. 2 is a schematic diagram illustrating an exemplary multi-band antenna structure in accordance with the invention.

FIG. 2 is a schematic diagram illustrating an exemplary multi-band antenna structure 11 in accordance with the invention. As describe above, antenna structure 11 includes inductive elements 20A and 20B ("20") and capacitive elements 22A and 22B ("22") that allow antenna structure 11 to radiate and tune energy at more than one frequency. In this manner, a single antenna structure may be used for wireless applications in multiple frequency bands.

Multi-band antenna structure 11 includes a radiating component 12 to tune and radiate energy. Radiating component comprises radiating elements 24A and 24B ("24"). Radiating elements 24 are referenced to a ground plane, i.e., carry the same potential as the ground plane. Radiating elements 24 may, for example, be dipole arms of a dipole antenna. Radiating component 12 and, more particularly, radiating elements 24 may be formed to create integrated inductive elements 20. Specifically, each of radiating elements 24 may be fabricated to form respective ones of inductive elements 20. For example, a portion of radiating element 24A may be fabricated using meander line techniques to realize inductive element 20A.

Capacitive elements 22 are formed on a different layer of a multi-layer circuit structure than radiating component 12 and inductive elements 20. Capacitive elements 22 provide radiating elements 24 with a parallel capacitive element. Capacitive elements 22 may, for example, be created using an isolated copper pour or other similar fabrication method. Other fabrication techniques may involve impregnating a material using sputtering, deposition or the like. The material may be a conductive or polarized material such as copper or some other ferromagnetic material. Capacitive elements 22 are located in close proximity to respective inductive elements 20.

Inductive elements 20 and capacitive elements 22 electromagnetically couple to one another, thus providing antenna structure 11 the ability to operate within multiple frequency bands. More specifically, inductive element 20 and capacitive element 22 electromagnetically couple to form a parallel tuned circuit that resonates at multiple frequencies. At lower radio frequencies, e.g., 2.4 GHz, inductive components 20 act as short circuits, in turn lengthening radiating elements 24. For example, radiating elements 24 radiate and tune energy at the lower radio frequency as if the lengths of radiating elements 24 were approximately L1.

At higher radio frequencies, e.g., 5.0 GHz, inductive components 20 act as open circuits, thereby shortening radiating elements 24 in order to radiate at higher radio frequencies. In fact, the open circuit created by inductive components 20 allows radiating elements 24 to radiate and tune energy at higher radio frequencies than the geometries of antenna structure 11 allow. In this manner, antenna structure 11 acts as a varying length antenna structure, thus allowing antenna structure 11 to operate as a multi-band antenna structure. In the example illustrated in FIG. 2, capacitive elements 22 and inductive elements 20 are substantially vertically aligned, resulting in a high level of electromagnetic coupling and thus a higher quality factor (Q) for the tuned circuit. One or more intermediate layers may separate the layer on which inductive elements 20 are located from the layer on which capacitive elements 22 are located.

Antenna structure 11 further comprises a conductive strip feed-line 26 that electromagnetically couples to radiating component 12. Conductive strip feed-line 26 is fabricated to form a balun 14. For example, conductive strip feed-line 26 may be fabricated to form a quarter-wave open circuit, as illustrated in FIG. 2, in order to realize balun 14. Conductive strip feed-line 26 may directly feed radiating component 12 and, more particularly, radiating elements 24. In general, the term "directly feed" refers to the electromagnetic coupling between conductive strip feed-line 26 and radiating component 12. In particular, the electromagnetic coupling between conductive strip feed-line 26 and radiating component 12 induces a signal on radiating component 12. Directly feeding radiating component 12 with conductive strip feed-line 26 eliminates the need for feed pins, soldering, or other connectors to attach antenna structure 11 to a multi-layer circuit structure. In this manner, multi-band antenna structure 11 reduces potential spurious radiation from the feed-line as well as parasitics associated with the balun feature.

Conductive strip feed-line 26 may be formed by any of a variety of fabrication techniques. For instance, printing techniques may be used to deposit a conductive trace, e.g., conductive strip feed-line 26, on a dielectric layer. Alternatively, a conductive layer (not shown) may be deposited on a dielectric layer and shaped, e.g., by etching, to form balun 14. More specifically, the conductive layer may be deposited on the dielectric layer using techniques such as chemical vapor deposition and sputtering. The conductive layer deposited on the dielectric layer may be shaped via etching, photolithography, masking, or a similar technique to form balun 14. Other fabrication techniques may involve impregnating a material using sputtering, deposition or the like. The material may be a conductive or polarized material such as copper or some other ferromagnetic material.

Because of the shape of conductive strip feed-line 26, e.g., the quarter-wavelength open circuit formed by conductive strip feed-line 26, the signal induced on radiating component 12 is a balanced signal. In particular, one of radiating elements 24, i.e., radiating element 24B, electromagnetically couples a portion of conductive strip feed-line 26 that forms a stub portion of the quarter-wavelength open circuit. The current on the stub portion of the quarter-wavelength open circuit is opposite the current on the rest of conductive strip feed-line 26, in turn, causing the signals induced on radiating elements 24A and 24B to have the same magnitude and a 180-degree phase difference, i.e., be balanced signals. Signal flow is reciprocal. Radiating component 12 receives a balanced signal and electromagnetically induces an unbalanced signal in conductive strip feed-line 26. In this manner, conductive strip feed-line 26 forms balun 14 that transforms received signals from balanced to unbalanced signals and vice versa. Balun 14 may be configured to perform impedance transformations in addition to converting between balanced signals and unbalanced signals.

As illustrated in FIG. 2, radiating component 12 is formed generally in the shape of an arrow. However, radiating component 12 may be formed in any shape. For example, radiating component 12 may be formed in the shape of the letter 'T' or 'Y'. The arrow shape of radiating component 12 illustrated in FIG. 2 may nevertheless have some advantages over other shapes such as the Y-shape or T-shape. The arrow shape of radiating component 12 may provide multi-band antenna structure 11 with a broad beamwidth radiation pattern suitable for non-directional free-space propagation. In this manner, the radiation pattern increases the transmitting and receiving capabilities of multi-band antenna structure 11 and is particularly well suited for many wireless applications, such as wireless local area networking (WLAN). The arrow shape of radiating component 12 may further reduce the amount of surface area needed for fabrication of multi-band antenna structure 11 within a multi-layer circuit structure.

A set of exemplary dimensions L1–L14 of multi-band antenna structure 11 are described herein. The dimensions L1–L14 represent an embodiment that allows multi-band antenna structure 11 to be tuned to operate within particular frequency bands to conform to multiple standards such as the IEEE 802.11(a), 802.11(b), 802.11(e) or 802.11(g) standards. Varying dimensions L1–L14 may further provide flexibility in impedance matching. Dimensions L1–L14 include a primary radiating element length L1, a capacitive element length L2, a secondary radiating element length L3, a radiating element width L4, conductive strip feed-line open-circuit stub length L5, conductive strip feed-line width L6, inductive element width L7, inductive element meander width L8, inductive element spacing L9, distance from radiating element to ground L10, balun slot length L11, overall structure height L12, balun slot width L13, and capacitive element width L14. Set forth in the TABLE below are exemplary dimensional ranges, set forth in terms of a dimension and an applicable tolerance range, for the various dimensions L1–L14. The dimensions are set forth in mils and millimeters.

TABLE

| Unit | Length (Mil) | Tolerance (+/− Mil) | Length (mm) | Tolerance (+/− mm) |
|---|---|---|---|---|
| L1 | 365 | 100 | 9.271 | 2.54 |
| L2 | 180 | 100 | 4.572 | 2.54 |
| L3 | 78 | 10 | 1.9812 | 0.254 |
| L4 | 110 | 10 | 2.794 | 0.254 |
| L5 | 365 | 100 | 9.271 | 2.54 |
| L6 | 8 | 5 | 0.2032 | 0.127 |
| L7 | 8 | 5 | 0.2032 | 0.127 |
| L8 | 21 | 5 | 0.5334 | 0.127 |
| L9 | 5 | 2 | 0.127 | 0.0508 |
| L10 | 145 | 50 | 3.683 | 1.27 |
| L11 | 470 | 150 | 11.938 | 3.81 |
| L12 | 650 | 100 | 16.51 | 2.54 |
| L13 | 10 | 5 | 0.254 | 0.127 |
| L14 | 110 | 200 | 2.794 | 5.08 |

Figure 3:
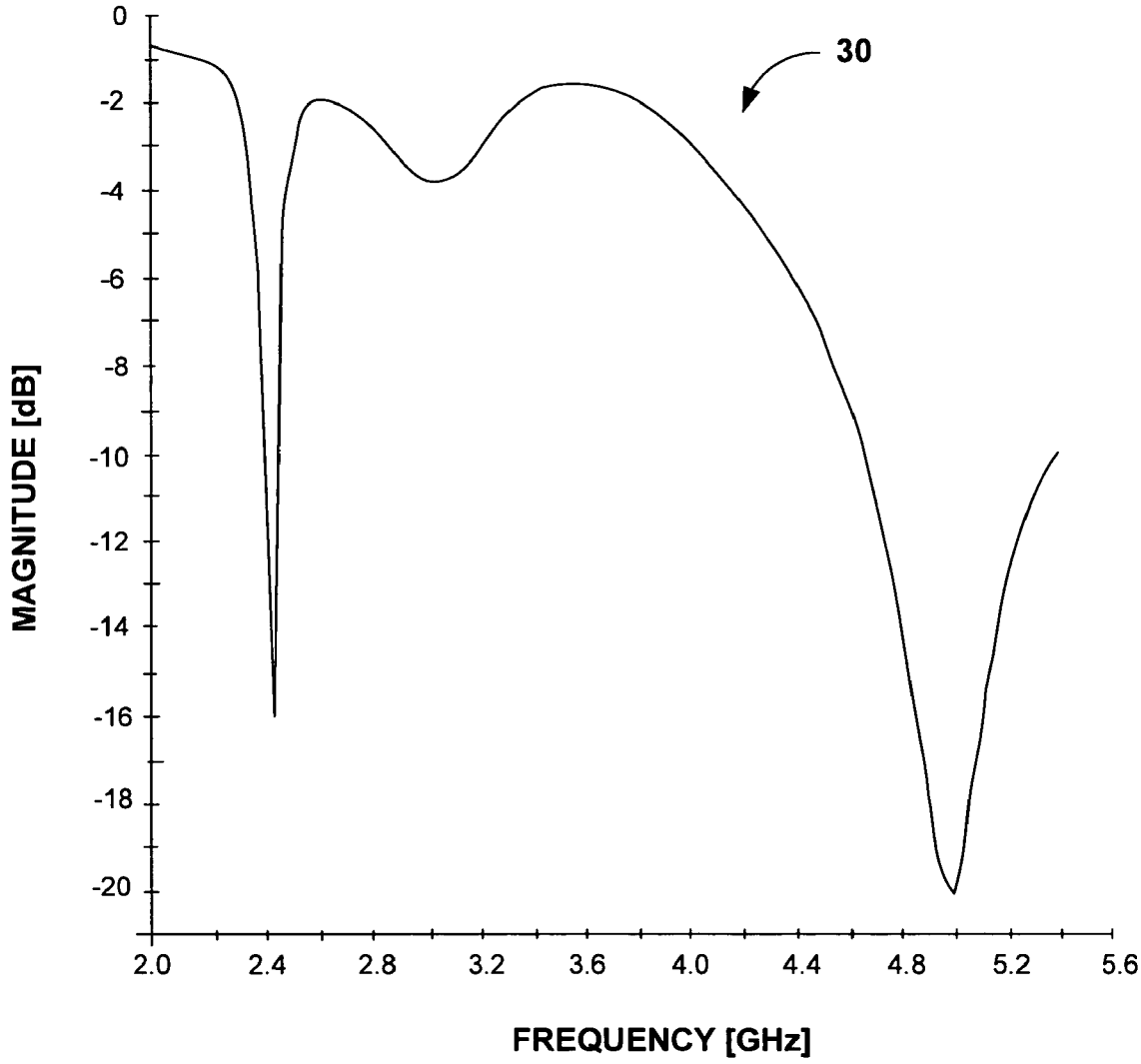
FIG. 3 is a frequency response diagram illustrating an exemplary frequency response of a multi-band antenna structure.

FIG. 3 is a frequency response diagram illustrating the frequency response of an exemplary multi-band antenna structure, such as multi-band antenna structure 11. Specifically, the frequency response diagram illustrates the magnitude of the frequency response. As illustrated by line 30 of FIG. 3, antenna structure 11 operates at approximately 2.4 GHz and 5.0 GHz. In other words, the tuned circuit created by the parallel combination of integrated inductive elements 20 and capacitive elements 22 resonates at approximately 2.4 GHz and 5.0 GHz, allowing antenna structure 11 to operate in frequency bands adjacent to the resonant frequencies. In this manner, multi-band antenna structure 11 can tune and radiate energy in the frequency bands necessary for communication in multiple IEEE 802.11 modes, e.g., 802.11 (a) and 802.11(g). The tuned circuit of antenna structure 11 further attenuates signals with frequencies outside of the frequency bands adjacent the resonant frequencies. In this manner, the tuned circuit of antenna structure 11 functions as a bandpass filter that passes signals in a narrow frequency band near 2.4 GHz, e.g., 2.4–2.5 GHz, and a narrow frequency band near 5.0 GHz, e.g., 4.9–5.9 GHz.

Multi-band antenna structure 11 may, however, be created to resonate at different frequencies. As described above, for example, certain dimensions of antenna structure 11 may be adjusted in order to realize a different set of operating frequencies. For example, the capacitive element length L2, inductive element width L7, inductive element meander width L8, inductive element spacing L9, or other dimension of antenna structure 11 may be adjusted to cause antenna structure 11 to operate in different frequency bands. In another example, the alignment of inductive elements 20 and capacitive elements 22 may cause the antenna structure to resonate and tune different frequency bands. Although in the example of FIG. 3 antenna structure 11 resonates and tunes energy at two different frequency bands, antenna structure 11 may be created to resonate and tune energy at more than two frequency bands.

Figure 4:
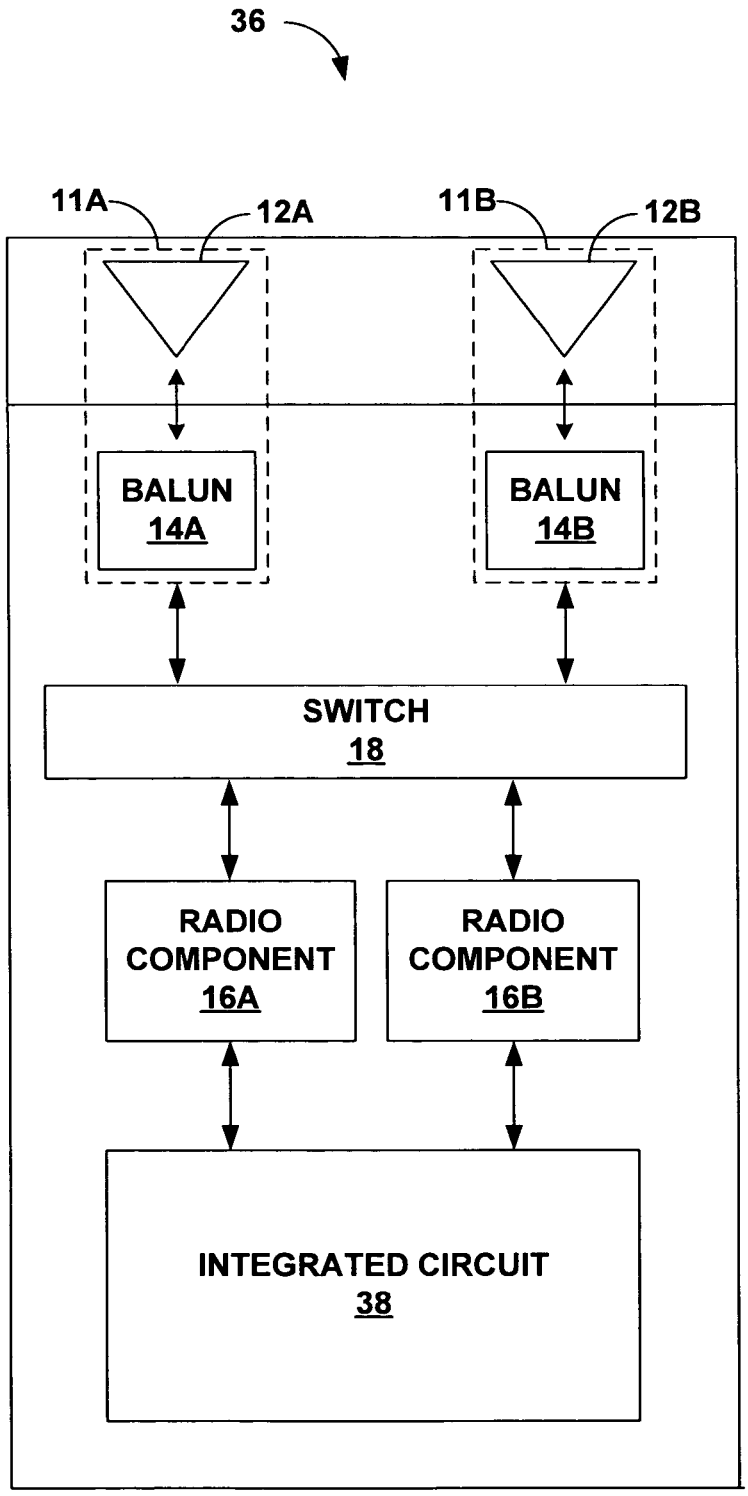
FIG. 4 is a block diagram illustrating a wireless card for wireless communication that incorporates a plurality of multi-band antenna structures.

FIG. 4 is a block diagram illustrating a wireless card 36 for wireless communication. Wireless card 36 includes multi-band antenna structures 11A and 11B ("11"), radio components 16A and 16B ("16") and an integrated circuit 38. In accordance with the principles of the invention, multi-band antenna structures 11 include integrated inductive elements and capacitive elements that function as a tuned circuit to allow antenna structures 11 to resonate and tune energy at more than one frequency. In addition, multi-band antennas 11 comprise radiating components 12A and 12B ("12") and conductive strip feed-lines (not shown) that form baluns 14A and 14B ("14").

Multi-band antenna structures 11 receive and transmit signals to and from wireless card 36. Multi-band antenna structures 11 may, for example, receive signals over multiple receive paths providing wireless card 36 with receive diversity. In this manner, multi-band antenna structure 11A provides a first receive path, and multi-band antenna structure 11B provides a second receive path. Antenna structures 11 provide receive diversity for each of the frequency bands within which antenna structures 22 operate.

As illustrated, multi-band antenna structures 11 couple to radio components 16A and 16B ("16") via a switch 18 or multiplexer. Switch 18 or a multiplexer directs energy between radio components 16 based on the frequency at which system 10 is operating. For example, radio component 16A may be a 2.4 GHz radio component and radio component 16B may be a 5.0 GHz radio component. In this case, switch 18 may couple antenna structures 11 to radio component 16A when antenna structures 11 are operating in a 2.4 GHz environment, e.g., an 802.11(g) environment, and couple antenna structures 11 to radio component 16B when antenna structures 11 are operating in a 5.0 GHz environment, e.g., an 802.11(a) environment.

Wireless card 36 may select the receive path with the strongest signal via one of radio components 16 that is currently coupled to antenna structures 11. Alternatively, wireless card 36 and, more particularly, the respective radio component 16 may combine the signals from the two receive paths. More than two multi-band antenna structures 11 may be provided in some embodiments for enhanced receive diversity. As an alternative, only a single multi-band antenna structure 11 may be provided in which case wireless card 36 does not make use of receive diversity. One or both of multi-band antenna structures 11 may further be used for transmission of signals from wireless card 36.

Radio components 16 may include transmit and receive circuitry (not shown). For example, radio components 16 may include circuitry for upconverting transmitted signals to radio frequency (RF), and downconverting RF signals to a baseband frequency for processing by integrated circuit 38. In this sense, radio components 16 may integrate both transmit and receive circuitry within a single transceiver component. In some cases, however, transmit and receive circuitry may be formed by separate transmitter and receiver components.

Integrated circuit 38 processes inbound and outbound signals. Integrated circuit 38 may, for instance, encode information in a baseband signal for upconversion to the RF band or decode information from RF signals received via antenna structures 11. For example, integrated circuit 38 may provide Fourier transform processing to demodulate signals received from a wireless communication network. Although in the example illustrated in FIG. 4 radio components 16 and integrated circuit 38 are discrete components, wireless card 36 may incorporate a single component that integrates radio components 16 and integrated circuit 38.

Multi-band antenna structures 11 reside within multiple layers of a multi-layer circuit structure. Multi-band antenna structures 11 may, for example, be formed within multiple layers of a printed circuit board. As described above, baluns 14 and radiating components 12 reside on different layers of a multi-layer circuit structure. Furthermore, the integrated inductive elements reside on a different layer than the capacitive elements. As will be described in further detail, the inductive elements are integrated within radiating components 12 of antenna structures 11. For example, a portion of radiating components 12 may be fabricated using the meander line technique to realize an integrated inductor element. In this manner, radiating components 12 and the integrated inductive elements reside on common layer and baluns 14 and the capacitive elements reside on a common layer. Alternatively, baluns 14 and the capacitive elements may reside on different layers, but neither of them resides on the same layer as radiating components 12 and the integrated inductive elements.

Wireless card 36 illustrated in FIG. 4 should be taken as exemplary of the type of device in which the invention may be embodied, however, and not as limiting of the invention as broadly embodied herein. For example, the invention may be practiced in a wide variety of devices, including RF chips, WLAN cards, WLAN access points, WLAN routers, cellular phones, personal computers (PCs), personal digital assistants (PDAs), and the like. As a particular example, wireless card 36 may take the form of a wireless local area networking (WLAN) card that conforms to multiple WLAN standards such as the IEEE 802.11(a) and 802.11(g) standards as described in detail above.

Figure 5:
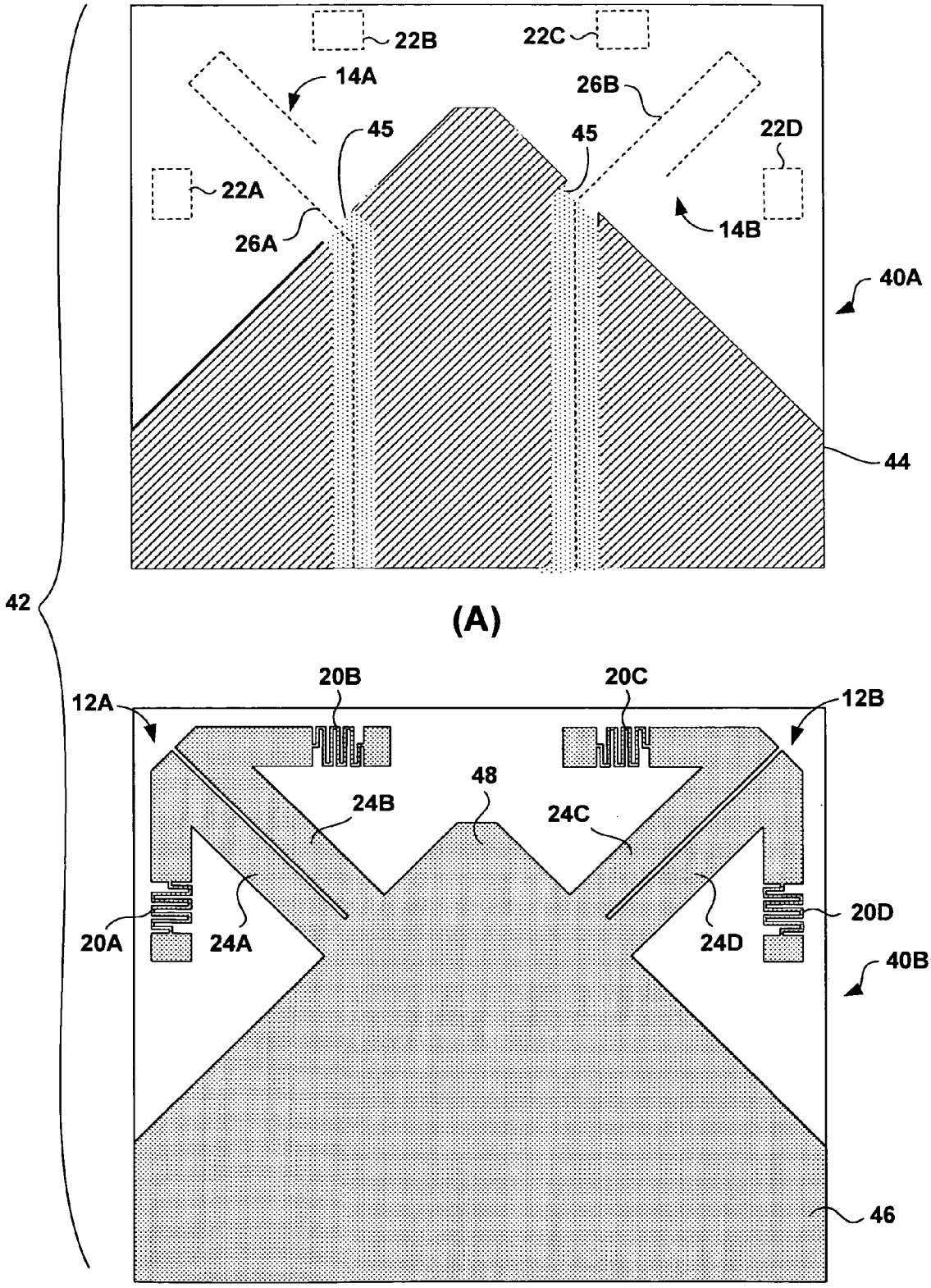
FIG. 5 is an exploded schematic diagram illustrating layers of a multi-layer circuit structure that includes a plurality of multi-band antenna structures.

FIG. 5 is an exploded view illustrating layers 40A and 40B ("40") of a multi-layer circuit structure 42, such as wireless card 36 of FIG. 4, in more detail. FIG. 5(A) illustrates a first layer 40A of multi-layer circuit structure 42, which includes conductive strip feed-lines 26A and 26B ("26") as well as capacitive distributed elements 22A–22D ("22"). FIG. 5(B) illustrates a second layer 40B of multi-layer circuit structure 42, which includes radiating components 12A and 12B ("12") with integrated inductive distributed elements 20A–20D ("20").

As described above, conductive strip feed-lines 26A and 26B may be fabricated to form baluns 14A and 14B ("14"), respectively. Conductive strip feed-lines 26 may, for example, be fabricated to form a quarter-wavelength open circuit in order to realize baluns 14. Conductive strip feed-lines 26 may extend from another component within multi-layer circuit structure 42, such as one of radio components 16 (FIG. 1), and directly feed radiating components 12. As described above, directly feeding radiating components 12 with conductive strip feed-lines 26 eliminates the need for feed pins, soldering, or other connectors to attach antenna structures 11 to the multi-layer circuit structure. In this manner, multi-band antenna structures 11 reduce potential spurious radiation from the feed-lines as well as parasitics associated with the balun feature. Layer 40A further includes capacitive distributed elements 22, which provide antenna structures 11 with frequency selectivity. Capacitive elements 22 may be formed using fabrication techniques such as an isolated copper pour.

FIG. 5(B) illustrates second layer 40B that includes radiating components 12 to transmit and receive signals. As described above, radiating components 12 may be fabricated to include inductive distributed elements 20. More particularly, each of radiating components 12 includes one or more radiating elements 24. For example, radiating component 12A includes radiating elements 24A and 24B. In the example of FIG. 5, radiating elements 24A–24D form arms of radiating component 14 of a dipole antenna. Each of radiating elements 24 includes an integrated inductive element 20. For instance, a portion of each of radiating elements 24 may be fabricated using meander line techniques in order to realize integrated inductive elements 20.

Radiating elements 24 and inductive elements 20 are referenced to a ground plane 46, i.e., carry a potential relative to ground plane 46. For instance, radiating elements 24 and inductive elements 20 may be formed from ground plane 46, may be mounted on ground plane 46, or may otherwise electrically couple to ground plane 46. In the example of FIG. 5, radiating elements 24 and inductive elements 20 are formed from ground plane 46. Ground plane 46 from which radiating elements 24 and inductive elements 20 are formed extends partially between radiating components 12. In other words, an edge 48 of ground plane 46 extends between radiating element 24B of radiating component 12A and radiating element 24C of radiating component 12B. However, edge 48 of ground plane 46 does not extend all the way between antenna structures 11, i.e., does not completely separate radiating components 12 because of the close proximity of radiating components 12A and 12B. In some embodiments, however, the ground plane may extend all the way between antenna structures 11.

Each of radiating components 12 is electromagnetically coupled to a respective one of conducting strip feed-lines 26 and, in turn, a respective one of baluns 14. More particularly, radiating component 12A is electromagnetically coupled to conducting strip feed-line 26A that forms balun 14A while radiating component 12B is electromagnetically coupled to conducting strip feed-line 26B that forms balun 14B. In this manner, conductive strip feed-lines 26 directly feed radiating components 12.

Additionally, each of inductive elements 20 is electromagnetically coupled to respective capacitive elements 22. In particular, the portion of radiating elements 24A and 24B that form integrated inductive elements 20A and 20B are electromagnetically coupled to capacitive elements 22A and 22B. Likewise, radiating component 12B and, more particularly, the portion of radiating elements 24C and 24D that form integrated inductive elements 20C and 20D are electromagnetically coupled to capacitive elements 22C and 22D. The electromagnetic coupling between inductive elements 20 and capacitive elements 22 create a parallel tuned circuit that allows antenna structures 11 of multi-layer circuit structure 42 to tune and radiate energy within multiple frequency bands. In this manner, antenna structures 11 act as multi-band antennas.

In operation, conductive strip feed-lines 26 carry an unbalanced signal from an unbalanced component within multi-layer circuit structure 42, such as radio circuitry 16. Electromagnetic coupling between conductive strip feed-lines 26 and radiating components 12 as well as the quarter wave open circuit formed by conductive strip feed-lines 26 induce a balanced signal on radiating components 12. More specifically, using radiating component 12A and conductive strip feed-line 26A as an example, radiating element 24A electromagnetically couples a non-stub portion of the quarter-wavelength open circuit formed by conductive strip feed-line 26A and radiating element 24B electromagnetically couples a stub portion of the quarter-wavelength open circuit.

The electromagnetic coupling induces a balanced signal on radiating elements 24A and 24B. Specifically, because the current on the stub portion of the quarter-wavelength open circuit coupling, i.e., the portion coupling to radiating component 24B, is opposite the current of the non-stub portion of the quarter-wavelength open circuit coupling to radiating element 24A the signals induced on radiating elements 24A and 24B have the same magnitude and a 180-degree phase difference. Antennas are reciprocal devices; thus, signal flow also occurs in the opposite direction, e.g., each radiating component 12 receives a balanced signal and electromagnetically induces an unbalanced signal on conductive strip feed-lines 26.

Conductive strip feed-lines 26 may further perform impedance transformations in addition to signal transformations. More particularly, the impedance transformation occurs due to conductive strip feed-lines 26 referencing different ground planes. For example, a portion of conductive strip feed-line 26A references a ground plane 44 and another portion of conductive strip feed-line 26A references ground plane 46. The portion of conductive strip feed-line 26A referencing ground plane 44 has a first impedance and the portion of conductive strip feed-line 26B referencing ground plane 46 has a second impedance. Another ground plane 45 may reside below conductive strip feed-lines 26A and 26B. The different impedances occur due to the distance between conductive strip feed-line 26A and the respective ground plane. Specifically, conductive strip feed-line 26A is in closer proximity to ground plane 44 than ground plane 46. The impedance transformation from the first impedance to the second impedance occurs at the point in which conductive strip feed-line 26A changes ground plane references from ground plane 44 to ground plane 46.

Radiating components 12 of FIG. 5 are formed in the shape of an arrow. The arrow shape of radiating components 12 provides multi-band antenna structures 11 with a broad beamwidth radiation pattern suitable for non-directional free-space propagation. In this manner, the radiation pattern increases the transmitting and receiving capabilities of multi-layer circuit structure 42 and is particularly well suited for WLAN applications. However, as described above, radiating components 12 may be formed in other shapes such as a T-shape, Y-shape, and the like.

Radiating components 12 of multi-band antenna structures 11 may be spaced to provide multi-layer circuit structure 42 with receive diversity. Receive diversity reduces problems encountered from multi-path propagation, such as destructive interference caused by traveling paths of different lengths. Multi-layer circuit structure 42 may, for example, have receive circuitry within radio components 16 that select the signal from the antenna structure that receives the strongest signal.

Radiating components 12 of multi-band antenna structures 11 may be spaced relative to one another such that at least one of radiating components 12 of antenna structures 11 will be in a position where the signal has not experienced significant distortion from the multi-path effects, which is referred to as spatial diversity. Alternatively, radiating components 12 may be configured to transmit and receive signals at different polarizations, e.g. left-hand circular polarization for radiation element 12A and right hand circular polarization for radiation element 12B, thereby achieving polarization diversity. Other diversity applications, such as frequency diversity, are also possible.

In addition, inductive elements 20 and capacitive elements 22 provide antenna structures 11 with the capability to operate at multiple frequencies. For example, the tuned circuits formed by inductive elements 20 and capacitive elements 22 allow antenna structures 11 to radiate and tune energy from more than one frequency band. In particular, at lower radio frequencies, e.g., 2.4 GHz, inductive components 20 act as short circuits, in turn virtually lengthening the length of radiating elements 24. For example, radiating elements 24 radiate and tune energy at the lower radio frequency as if the lengths of radiating elements 24 were approximately L1+L2+L3. At higher radio frequencies, e.g., 5.0 GHz, inductive components 20 act as open circuits, thereby shortening radiating elements 24 in order to radiate at higher radio frequencies, with an effective length of approximately L1. In fact, the shortening of inductive components 20 allows radiating elements 24 to radiate and tune energy at higher radio frequencies than the geometries of antenna structure 11 ordinarily would allow. In this manner, antenna structure 11 acts as a varying length antenna structure, thus allowing antenna structure 11 to operate as a multi-band antenna structure.

As illustrated in FIG. 5, layers 40A and 40B may be oriented such that conductive strip feed-lines 26 are substantially aligned with a length of radiating component 12 to provide the electromagnetic coupling. More particularly, conductive strip feed-lines 26 form a quarter-wavelength open circuit in which one of the sides of the quarter-wavelength open circuit, e.g., the stub side, aligns with one of the radiating elements 24 of radiating component 12 and the other side of the quarter-wavelength open circuit aligns with one of the other radiating element 24 of radiating component 12.

Although in the example illustrated in FIG. 5 the layer with conductive strip feed-lines 26 and capacitive elements 22, i.e., layer 40A, is on top of the layer with radiating components 12 and inductive elements 20, i.e., layer 40B, the layering may be reversed. For example, layer 40B may be on top of layer 40A. Further, one or more layers may be interspersed between layers 40A and 40B. For example, a layer that includes conductive traces for other components of multi-layer circuit structure 42 may be interspersed between layers 40A and 40B.

The radiating component may be formed with certain dimensions in order to be tuned to particular operating frequency ranges to conform to a number of standards such as the IEEE 802.11(a), 802.11(b), 802.11(e) or 802.11(g) standards. For example, the multi-band antenna structures 11 may be formed with a particular capacitive element length L2, inductive element width L7, inductive element meander width L8, inductive element spacing L9, or other dimension of antenna structure 11 may be adjusted to cause antenna structure 11 to operate in different frequency bands. In another example, the alignment of inductive elements 20 and capacitive elements 22 may cause the antenna structure to resonate and tune different frequency bands.

Figure 6:
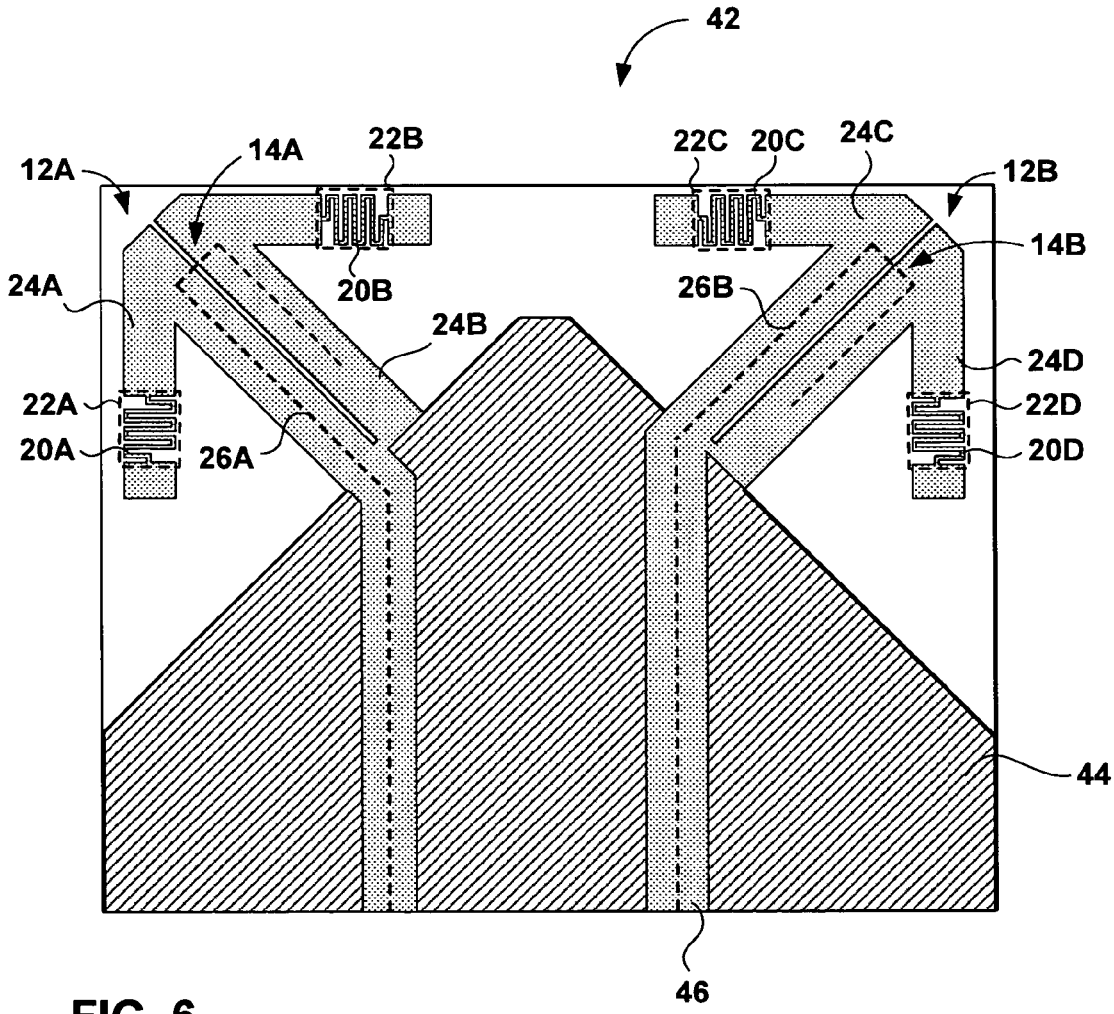
FIG. 6 is a schematic diagram of the multi-layer circuit structure of FIG. 5 with the layers stacked on top of one another.

FIG. 6 is a schematic diagram illustrating multi-layer circuit structure 42 with layer 40A imposed on top of layer 40B. As described above, inductive elements 20 electromagnetically couple to capacitive elements 22 in order to create a tuned circuit that resonates at multiple frequencies, thus allowing the antennas of multi-layer circuit structure 42 to operate in multiple frequency bands. In alternate embodiments, layer 40B may be imposed on top of layer 40A.

Various embodiments of the invention have been described. These and other embodiments are within the scope of the following claims.

The invention claimed is:

1. An antenna comprising:

a radiating component to transmit and receive signals, wherein the radiating component includes a first radiating element having a first integrated inductive element, and a second radiating element having a second integrated inductive element; and first and second capacitive elements, wherein the first capacitive element electromagnetically couples to the first integrated inductive element and the second capacitive element electromagnetically couples to the second integrated inductive element to form a tuned circuit that allows the antenna to operate in more than one frequency range, wherein the radiating component is formed on a first layer of a multi-layer circuit structure, and the capacitive elements are formed on a second layer of the multi-layer circuit structure.

2. The antenna of claim 1, wherein the first capacitive element is substantially vertically aligned with the first inductive element, and the second capacitive element is substantially vertically aligned with the second inductive element.

3. The antenna of claim 1, further comprising one or more intermediate layers to separate the first and second layers.

4. The antenna of claim 1, wherein a portion of the first radiating element is disposed as a meander line to form the first inductive element, and a portion of the second radiating element is disposed as a meander line to form the second inductive element.

5. The antenna of claim 1, wherein the tuned circuit allows the antenna to operate in a 2.4 GHz frequency range and a 5.0 GHz frequency range.

6. The antenna of claim 1, wherein the first capacitive element has a surface area that is substantially commensurate with a region containing the first inductive element, and the second capacitive element has a surface area that is substantially commensurate with a region containing the second inductive element.

7. The antenna of claim 1, wherein the radiating component comprises one of an arrow shaped radiating component, a T-shaped radiating component, and a Y-shaped radiating component.

8. The antenna of claim 1, further comprising a conductive strip feed-line that electromagnetically couples to the radiating component to directly feed the radiating component, wherein the conductive strip feed-line forms a balun.

9. A wireless communication device comprising:

a transmitter;

a receiver; and an antenna coupled to at least one of the transmitter and the receiver, the antenna including:

a radiating component to transmit and receive signals, wherein the radiating component includes a first radiating element having a first integrated inductive element, and a second radiating element having a second integrated inductive element; and first and second capacitive elements, wherein the first capacitive element electromagnetically couples to the first integrated inductive element and the second capacitive element electromagnetically couples to the second integrated inductive element to form a tuned circuit that allows the antenna to operate in more than one frequency range, wherein the radiating component is formed on a first layer of a multi-layer circuit structure, and the capacitive elements are formed on a second layer of the multi-layer circuit structure.

10. The device of claim 9, wherein the first capacitive element is substantially vertically aligned with the first inductive element, and the second capacitive element is substantially vertically aligned with the second inductive element.

11. The device of claim 9, further comprising one or more intermediate layers to separate the first and second layers.

12. The device of claim 9, wherein a portion of the first radiating element is disposed as a meander line to form the first inductive element, and a portion of the second radiating element is disposed as a meander line to form the second inductive element.

13. The device of claim 9, wherein the tuned circuit allows the antenna to operate in a 2.4 GHz frequency range and a 5.0 GHz frequency range.

14. The device of claim 9, wherein the transmitter and the receiver operating according to at least one of the IEEE 802.11a, 802.11b, 802.11e and 802.11g protocols.

15. The device of claim 9, wherein the device is a wireless local area networking card.

16. The device of claim 9, wherein the device is a wireless local area networking access point.

17. The device of claim 9, wherein the first capacitive element has a surface area that is substantially commensurate with a region containing the first inductive element, and the second capacitive element has a surface area that is substantially commensurate with a region containing the second inductive element.

18. The device of claim 9, wherein the radiating component comprises one of an arrow shaped radiating component, a T-shaped radiating component, and a Y-shaped radiating component.

19. The antenna of claim 9, further comprising a conductive strip feed-line that electromagnetically couples to the radiating component to directly feed the radiating component, wherein the conductive strip feed-line forms a balun.

20. A method comprising transmitting and receiving wireless signals via an antenna comprising a radiating component that includes a first radiating element having a first integrated inductive element, and a second radiating element having a second integrated inductive element, and first and second a capacitive elements, wherein the first capacitive element electromagnetically couples to the first integrated inductive element and the second capacitive element electromagnetically couples to the second integrated inductive element to form a tuned circuit that allows the antenna to operate in more than one frequency range, wherein the radiating component is formed on a first layer of a multi-layer circuit structure, and the capacitive elements are formed on a second layer of the multi-layer circuit structure.

21. The method of claim 20, wherein the first capacitive element is substantially vertically aligned with the first inductive element, and the second capacitive element is substantially vertically aligned with the second inductive element.

22. The method of claim 20, further comprising one or more intermediate layers to separate the first and second layers.

23. The method of claim 20, wherein a portion of the first radiating element is disposed as a meander line to form the first inductive element and a portion of the second radiating element is disposed as a meander line to form the second inductive element.

24. The method of claim 20, further comprising transmitting and receiving wireless signals in a 2.4 GHz frequency range and a 5.0 GHz frequency range.

25. The method of claim 20, wherein the first capacitive element has a surface area that is substantially commensurate with a region containing the first inductive element, and the second capacitive element has a surface area that is substantially commensurate with a region containing the second inductive element.

26. The method of claim 20, wherein the radiating component comprises one of an arrow shaped radiating component, a T-shaped radiating component, and a Y-shaped radiating component.

27. The method of claim 20, further comprising a conductive strip feed-line that electromagnetically couples to the radiating component to directly feed the radiating component, wherein the conductive strip feed-line forms a balun.

* * * * *